US006659135B2

(12) United States Patent
Sorkin

(10) Patent No.: US 6,659,135 B2
(45) Date of Patent: Dec. 9, 2003

(54) TENDON-RECEIVING DUCT WITH LONGITUDINAL CHANNELS

(76) Inventor: Felix L. Sorkin, 13022 Trinity Dr., P.O. Box 1503, Stafford, TX (US) 77497

( * ) Notice: Subject to any disclaimer, the term of this patent is extended or adjusted under 35 U.S.C. 154(b) by 221 days.

(21) Appl. No.: 09/752,126

(22) Filed: Dec. 29, 2000

(65) Prior Publication Data

US 2002/0083991 A1 Jul. 4, 2002

(51) Int. Cl.[7] ..... F16L 11/00
(52) U.S. Cl. ..... 138/121; 138/177; 138/173
(58) Field of Search ..... 138/121, 173, 138/177

(56) References Cited

U.S. PATENT DOCUMENTS 3,578,777 A * 5/1971 DeGain ..... 138/121
3,605,817 A * 9/1971 Bauman et al. ..... 138/121
3,715,454 A * 2/1973 Kleykamp ..... 138/121
4,194,081 A * 3/1980 Medford et al. ..... 174/47
4,592,231 A * 6/1986 Kant ..... 73/295
5,439,035 A * 8/1995 Attilio Dal Palù ..... 138/121
5,474,335 A 12/1995 Sorkin ..... 285/322
5,706,864 A * 1/1998 Pfleger ..... 138/121
5,792,532 A * 8/1998 Pfleger ..... 138/121
D400,670 S 11/1998 Sorkin ..... D23/393
5,944,059 A * 8/1999 Masui ..... 138/121
5,954,373 A 9/1999 Sorkin ..... 285/312

* cited by examiner

*Primary Examiner*—Patrick Brinson
(74) *Attorney, Agent, or Firm*—Harrison & Egbert

(57) ABSTRACT

A tendon-receiving duct having a tubular body with an interior passageway and a plurality of corrugations extending radially outwardly of the tubular body. Each of the plurality of corrugations has an interior opening to the interior passageway. The tubular body has longitudinal channels formed on the tubular body so as to establish fluid communication between adjacent pairs of the corrugations. The tubular body is formed of a polymeric material. The channels are formed on the outer wall of the tubular body and open to the interior passageway of the tubular body and extend for the length of the tubular body.

13 Claims, 4 Drawing Sheets

TENDON-RECEIVING DUCT WITH LONGITUDINAL CHANNELS

BACKGROUND OF THE INVENTION

1. Field of the Invention

The present invention relates to ducts as used in post-tension construction. More particularly, the present invention relates to the formation of a polymeric duct used for retaining multi-strand tensioning systems within an encapsulated environment.

2. Description of Related Art

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete maybe constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

Multi-strand tensioning is used when forming especially long post-tensioned concrete structures, or those which must carry especially heavy loads, such as elongated concrete beams for buildings, bridges, highway overpasses, etc. Multiple axially aligned strands of cable are used in order to achieve the required compressive forces for offsetting the anticipated loads. Special multi-strand anchors are utilized, with ports for the desired number of tensioning cables. Individual cables are then strung between the anchors, tensioned and locked as described above for the conventional monofilament post-tensioning system.

As with monofilament installations, it is highly desirable to protect the tensioned steel cables from corrosive elements, such as de-icing chemicals, sea water, brackish water, and even rain water which could enter through cracks or pores in the concrete and eventually cause corrosion and loss of tension of the cables. In multi-strand applications, the cables typically are protected against exposure to corrosive elements by surrounding them with a metal duct or, more recently, with a flexible duct made of an impermeable material, such as plastic. The protective duct extends between the anchors and in surrounding relationship to the bundle of tensioning cables. Flexible duct, which typically is provided in 20 to 40 foot sections is sealed at each end to an anchor and between adjacent sections of duct to provide a water-tight channel. Grout then may be pumped into the interior of the duct in surrounding relationship to the cables to provide further protection.

Various patents have issued, in the past, for devices relating to such multi-strand duct assemblies. For example, U.S. Design Pat. No. 400,670, issued on Nov. 3, 1998, to the present inventor, shows a design of a duct. This duct design includes a tubular body with a plurality of corrugations extending outwardly therefrom. This tubular duct is presently manufactured and sold by General Technologies, Inc. of Stafford, Tex., the licensee of the present inventor. In particular, FIGS. 1 and 2 are illustrations of the prior art duct that is being manufactured by General Technologies, Inc.

As can be seen in FIG. 1, the tubular duct 10 has a tubular body 12 and a plurality of corrugations 14 which extend radially outwardly from the outer wall 16 of the tubular body 12. The tubular body 12 includes an interior passageway 14 suitable for receiving multiple post-tension cables and strands therein. The interior passageway 18 of the tubular body 12 is suitable for receiving a grout material so as to maintain the multiple strands in a liquid-tight environment therein. FIG. 2 shows the tubular body 12 as having the corrugations 14 extending outwardly in generally spaced parallel relationship to each other and in transverse relationship to the longitudinal axis of the tubular body 12. A wall 16 will extend between the corrugations 14. The tubular body 12, along with the corrugations 16, are formed of a polymeric material. The duct 12 can be any length, as desired. Couplers can be used so as to secure lengths of duct 10 together in end-to-end relationship.

One of the problems associated with the prior art duct 10 is that it is not stiff enough in the longitudinal direction. The duct 10 will flex too easily. It becomes difficult to profile such an easily flexible duct. When the cables are being installed in the interior passageway 18, the cablepusher used to install the cable within the interior passageway 18 is likely to strike the walls of the interior passageway 18 when the duct is flexed. Because of the force used to install the cable through the duct 10, the walls of the duct can break or become damaged if the cable strikes the walls of the duct. It is desirable to manufacture a duct 10 with greater stiffness and rigidity in the longitudinal direction so as to avoid the flexing and deflection of the duct.

An additional problem with the duct 10, as shown in FIGS. 1 and 2, is that air has a possibility of being trapped in the corrugations. When air bubbles form within the interior of the corrugations, the grout used to seal the interior 18 does not effectively encapsulate the cable on the interior 18. As such, it is desirable to manufacture the duct 10 such that the potential for trapped air bubbles within the corrugations 14 is reduced.

The present inventor is also the inventor of U.S. Pat. No. 5,474,335, issued on Dec. 12, 1995. This patent describes a duct coupler for joining and sealing between adjacent sections of duct. The coupler includes a body and a flexible cantilevered section on the end of the body. This flexible cantilevered section is adapted to pass over annular protrusions on the duct. Locking rings are used to lock the flexible cantilevered sections into position so as to lock the coupler onto the duct. U.S. Pat. No. 5,762,300, issued on Jun. 9, 1998, to the present inventor, describes a tendon-receiving duct support apparatus. This duct support apparatus is used for supporting a tendon-receiving duct. This support apparatus includes a cradle for receiving an exterior surface of a duct therein and a clamp connected to the cradle and extending therebelow for attachment to an underlying object. The cradle is a generally U-shaped member having a length greater than a width of the underlying object received by the clamp. The cradle and the clamp are integrally formed together of a polymeric material. The underlying object to which the clamp is connected is a chair or a rebar.

U.S. Pat. No. 5,954,373, issued on Sep. 21, 1999, to the present inventor, shows another duct coupler apparatus for use with ducts on a multi-strand post-tensioning system. The coupler includes a tubular body with an interior passageway between a first open end and a second open end. A shoulder is formed within the tubular body between the open ends. A seal is connected to the shoulder so as to form a liquid-tight seal with a duct received within one of the open ends. A compression device is hingedly connected to the tubular body for urging the duct into compressive contact with the seal. The compression device has a portion extending exterior of the tubular body.

It is an object of the present invention to provide a tendon-receiving duct which improves the rigidity of the duct in the longitudinal direction.

It is another object of the present invention to provide a tendon-receiving duct which facilitates the removal of air bubbles within the interior of the duct.

It is a further object of the present invention to provide a tendon-receiving duct apparatus which facilitates the ability to install the cable within the duct.

It is still a further object of the present invention to provide a tendon-receiving duct which is easy to manufacture, easy to use, and relatively inexpensive, These and other objects and advantages of the present invention will become apparent from a reading of the attached specification and appended claims.

BRIEF SUMMARY OF THE INVENTION

The present invention is a tendon-receiving duct comprising a tubular body having a longitudinal axis. The tubular body has a plurality of corrugations extending radially outwardly therefrom. Each of the plurality of corrugations is in spaced relationship to an adjacent corrugation. The tubular body has an interior passageway suitable for receiving tendons therein. Each of the plurality of corrugations opens to the interior passageway. The tubular body has a longitudinal channel extending between adjacent pairs of plurality of corrugations.

In the present invention, the tubular body has a wall extending between the adjacent pair of corrugations. The longitudinal channel extends outwardly of this wall. The longitudinal channel has an interior which opens to the interior passageway of the tubular body. The longitudinal channel also has one end which opens to one of the pairs of corrugations and at an opposite end which opens to the other of the pair of corrugations. A plurality of longitudinal channels extend around the tubular body between the adjacent pair of corrugations. Each of the plurality of longitudinal channels is spaced by an equal radial distance from an adjacent longitudinal channel.

The plurality of corrugations can be connected together in fluid communication by the longitudinal channel. The longitudinal channel extends to each of the plurality of corrugations. The longitudinal channel will extending outwardly of the tubular body by a distance equal to the distance that the plurality of corrugations extend outwardly of the tubular body.

In one embodiment of the present invention, the tubular body has a circular cross-section in a plane transverse to the longitudinal axis of the tubular body. In another embodiment of the present invention, the tubular body has an oval cross-section in a plane transverse to a longitudinal axis of the tubular body.

The present invention can further comprise a plurality of tendons which extend through the interior passageway of the tubular body, and a grout material which fills the interior passageway of the tubular body. The grout material fills the plurality of corrugations and the longitudinal channel.

DETAILED DESCRIPTION OF THE INVENTION

Figure 1:
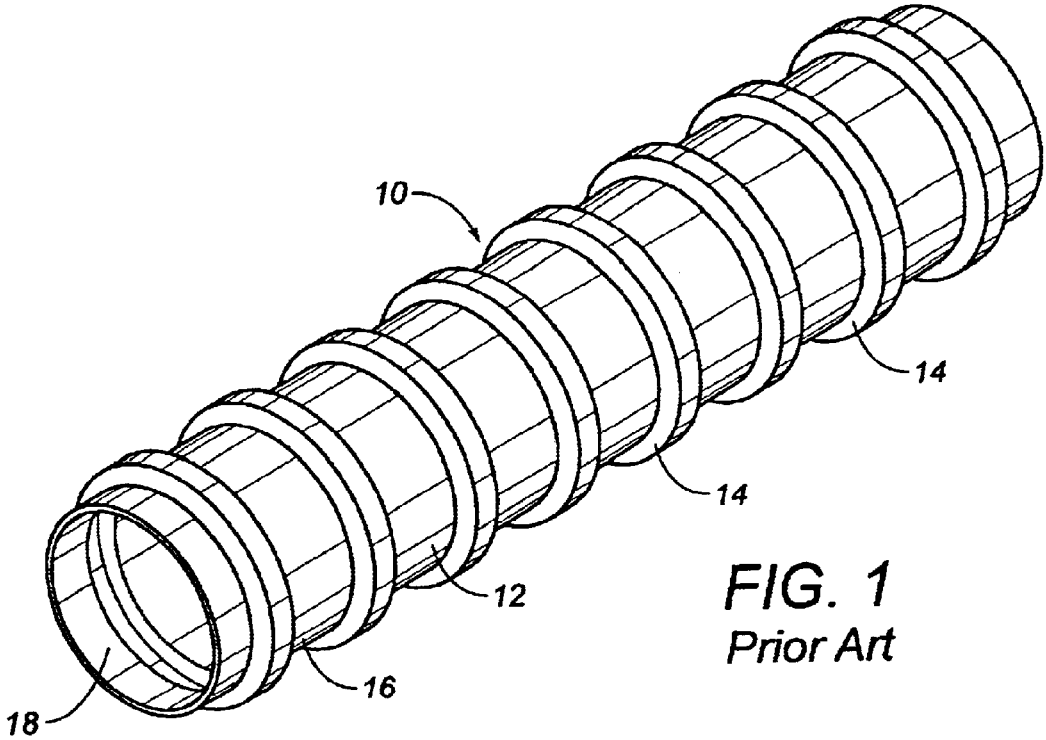
FIG. 1 Prior Art
FIG. 1 is a upper perspective view showing a prior art tendon-receiving duct.
Figure 2:
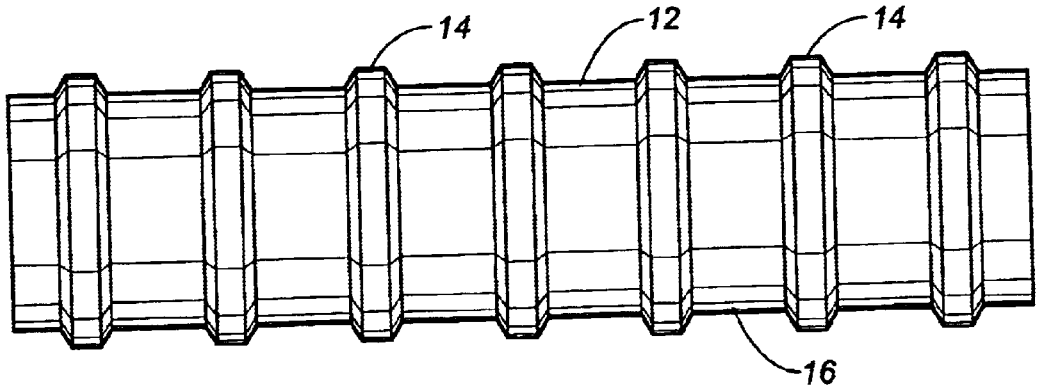
FIG. 2 Prior Art
FIG. 2 is a side elevational view of the prior art tendon-receiving duct, as shown in FIG. 1.
Figure 3:
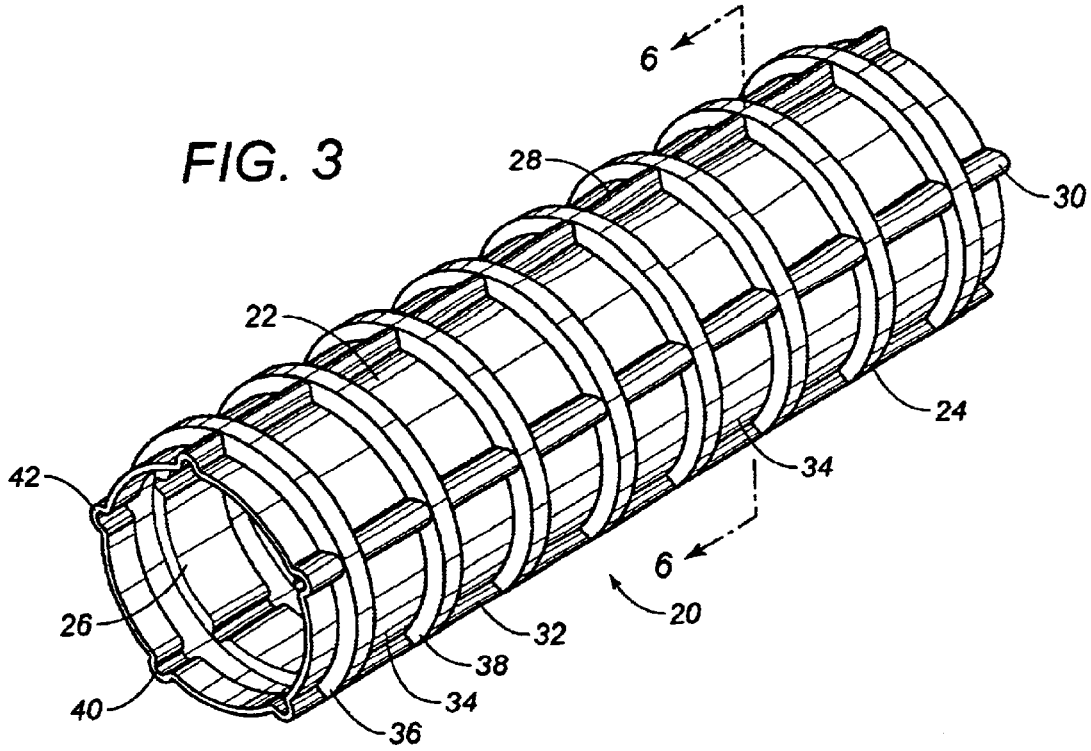
FIG. 3 is an upper perspective view of the tendon-receiving duct in accordance with the teachings of the present invention.

Referring to FIG. 3, there is shown the tendon-receiving duct 20 in accordance with the teachings of the preferred embodiment of the present invention. The tendon-receiving duct 20 includes a tubular body 22 having a plurality of corrugations 24 extending radially outwardly of the tubular body 22. Each of the corrugations 24 is in spaced relationship to an adjacent corrugation 24. The tubular body 22 has an interior passageway 26 suitable for receiving tendons (or post-tension cables) therein. Each of the plurality of corrugations 24 open within the tubular body 22 to the interior passageway 26. Longitudinal channels 28,30 and 32 are formed on the tubular body 22 and communicate between the corrugations 24.

The tubular body 22 has a wall section 34 formed between the corrugations 36 and 38, for example. The wall portion 34 will define the inner wall of the interior passageway 26. The longitudinal channel 28 will extend between the corrugation 36 and the corrugation 38 in parallel relationship to the longitudinal axis of the tubular body 22. Similarly, the longitudinal channel 30 will extend between the corrugation 36 and the corrugation 38. Longitudinal channel 32 extends also between the corrugation 36 and the corrugation 38. Each of the longitudinal channels 28, 30 and 32 have a first end opening into the corrugation 36 and a second end opening into the corrugation 38. Each of the longitudinal channels 28,30 and 32 have an interior which opens to the interior passageway 26.

In normal use, when grout is introduced into the interior passageway 26, it will begin to fill the voids within the interior passageway 26. The grout will initially fill the interior of the corrugation 36 and push air bubbles outwardly therefrom. These air bubbles can migrate along the channels 28, 30 and 32 toward the corrugation 38. Eventually, the grout will fill the channels 28, 30 and 32 and slowly move into the interior of corrugation 38. As such, air bubbles within the corrugation 38 are pushed further outwardly along the length of the respective longitudinal channels 28, 30 and 32. The longitudinal channels 28, 30 and 32 will communicate between the multiple corrugations formed on the exterior of the tubular body 22.

Importantly, the longitudinal channels 28, 30 and 32 provide rigidity and stiffness in the longitudinal direction of the tubular body 22. As such, the tubular body 22 is less likely to curl up, whip or wobble during the installation of the tendons by a cablepusher. Because of the added stiffness provided by the longitudinal channels associated with the tubular body 22, installation of cables can occur in a quicker and more convenient manner. There is less likely of duct breakage when the tendons can be installed in a quick and easy manner without wobble or whip by the duct 20.

Figure 4:
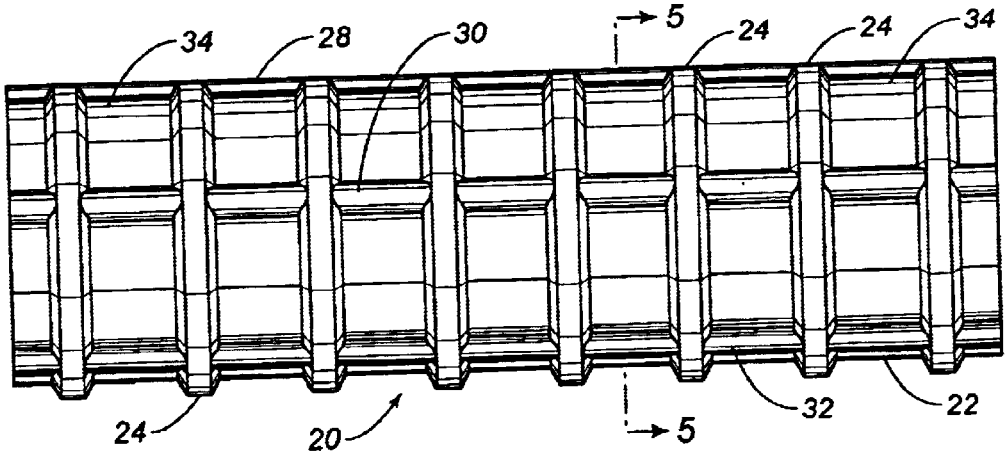
FIG. 4 is a side elevational view of the tendon-receiving duct in accordance with the teachings of the present invention.

FIG. 4 shows a side view of the duct 20 of the present invention. In FIG. 4, it can be seen that the longitudinal channels 28, 30 and 32 can extend generally for the length of the tubular body 22. Each of the longitudinal channels 28, 30 and 32 will communicate with the various corrugations 24 therebetween. The longitudinal channels 28, 30 and 32 are equally radially spaced from adjacent channels around the diameter of the tubular body 22. In the embodiment shown in FIGS. 3 and 4, a total of five longitudinal channels will be formed. The longitudinal channels extend outwardly of the wall portion 34 between the respective pairs of corrugations 24. Each of the longitudinal channels 28, 30 and 32 will extend outwardly from the wall 34 a distance equal to the amount that the corrugations 24 extend outwardly from the wall 34.

Figure 5:
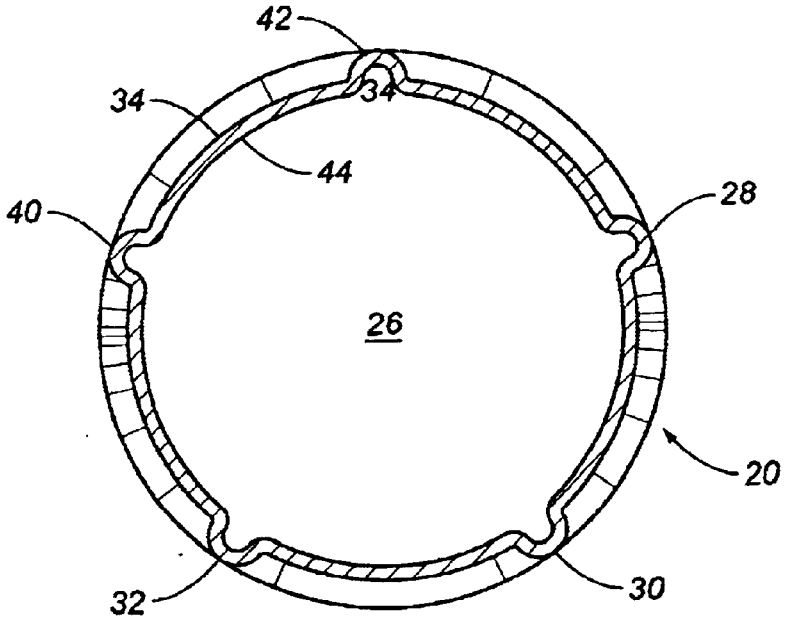
FIG. 5 is a cross-sectional view as taken across lines 5—5 of FIG. 4.

FIG. 5 is a cross-sectional view showing the configuration of the various longitudinal channels 28,30,32, 40 and 42. IN FIG. 5, the arrangement of the longitudinal channels 28,30, 32,40 and 42 is particularly illustrated. Each of the channels is spaced an equal radial distance from an adjacent channel. Each of the channels 28, 30, 32, 40 and 42 extends outwardly from the wall 34 a distance equal to the amount that the corrugation 24 extends outwardly from the wall 30. Wall 30 has an inner surface 44 which defines the interior passageway 26 of the duct 20. Each of the longitudinal channels 28, 30, 32, 40 and 42 has an interior which communicates with the interior passageway 26 of duct 20. In this arrangement, the grout can flow freely through the various channels 28,30,32,40 and 42 so as to enter the corrugations 24. The outwardly extending channels 28, 30, 32, 40 and 42 will add rigidity and stiffness along the longitudinal direction of the duct 20. In FIG. 5, it can be seen that the duct 20 is circular in cross-section transverse to the longitudinal axis of the duct 20.

Figure 6:
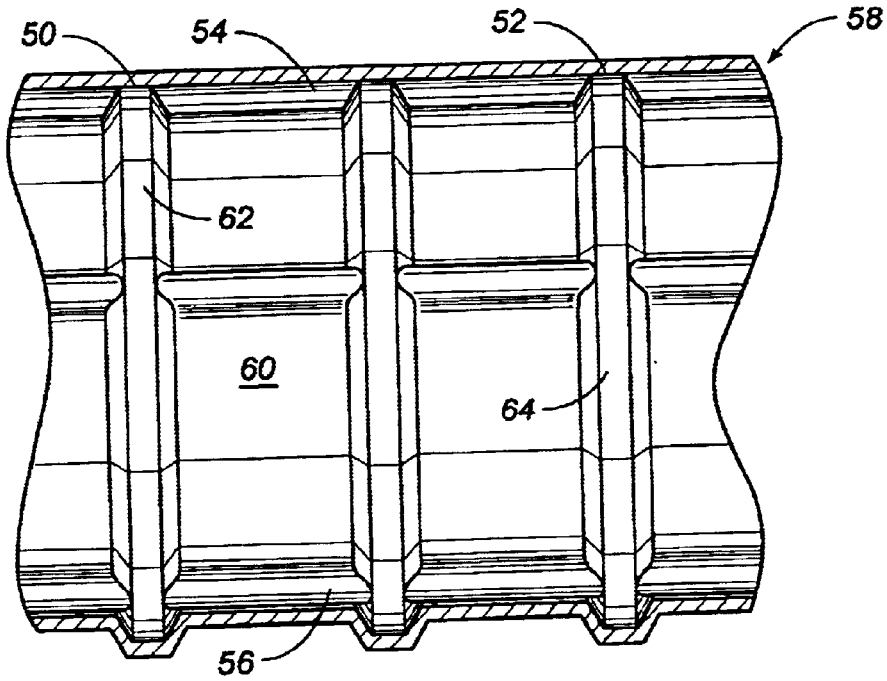
FIG. 6 is a partial cross-sectional view taken across lines 6—6 of FIG. 3.

FIG. 6 shows a close up illustration of the relationship of corrugations 50 and 52 relative to the longitudinal channels 54 and 56. The corrugation 58, illustrated in FIG. 6, has an interior passageway 64. Each of the longitudinal channels 54 and 56 will communicate with the interior 64 of the corrugation 50 at one end of the channels 54 and 56. Similarly, each of the channels 54 and 56 will communicate with the interior 64 of corrugation 64 at the other end of the longitudinal channels. As grout fills the interior 62 of the corrugation 50 it will eventually push the air bubbles outwardly therefrom and migrate along the longitudinal channels 54 and 56 so as to enter the corrugation 52.

Figure 7:
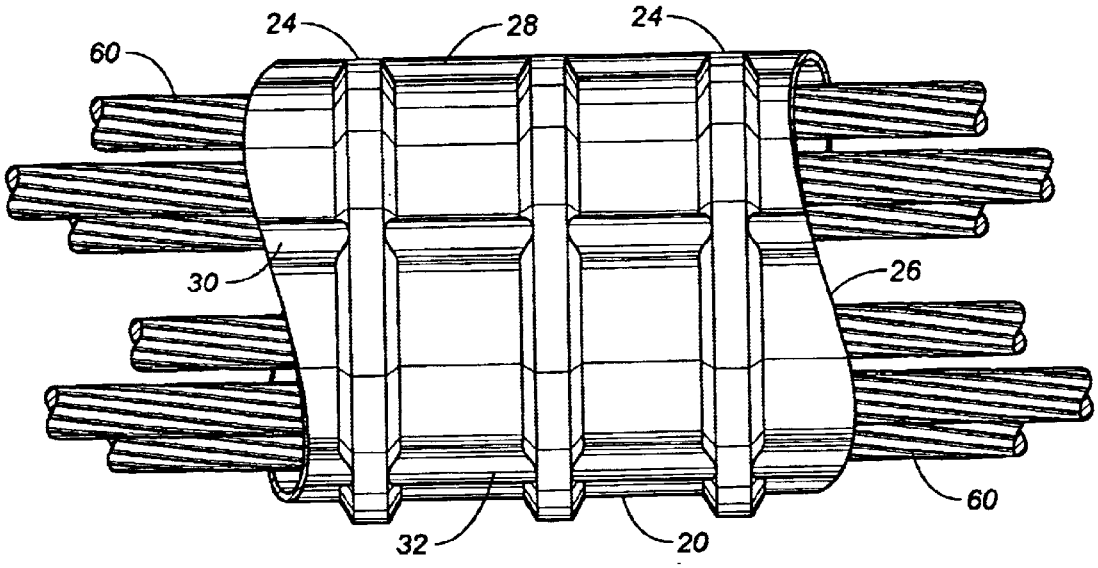
FIG. 7 is a side elevational view showing the tendon-receiving duct of the present invention with tendons installed therein.

FIG. 7 shows the installation of tendons or cables 60 through the interior passageway 26 of the duct 20. After the tendon 60 are installed into the interior 26 of the duct 20, the grout can be introduced therein so as to flow through the interior passageway 26 so as to fill any voids or spaces within the interior passageway 26 between the tendon 60 and the inner walls of the duct 20. This grout will also fill the corrugations 24 and the longitudinal channels 28, 30 and 32.

Figure 8:
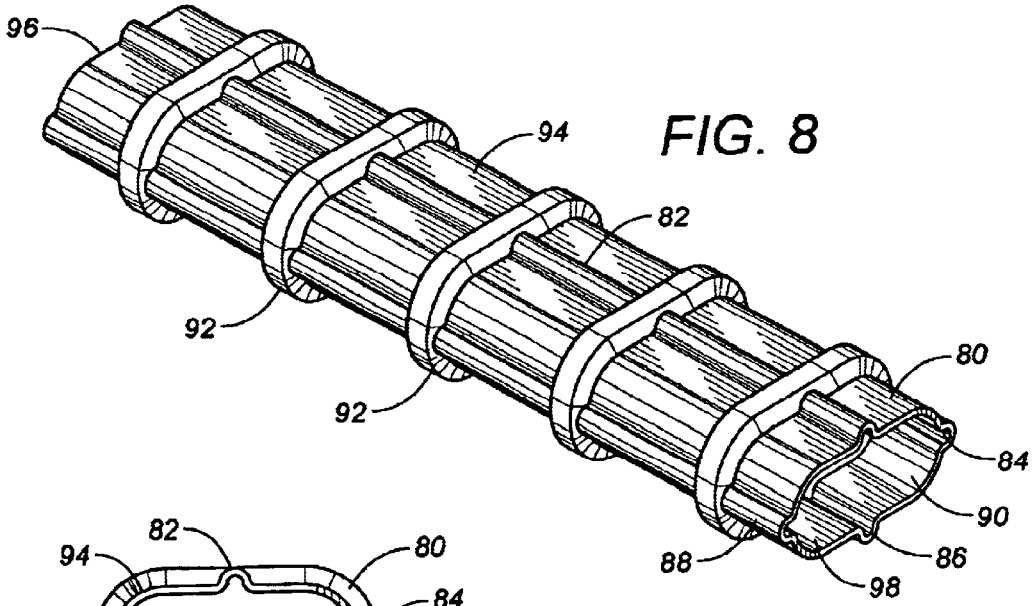
FIG. 8 is an upper perspective view showing an alternative embodiment of the tendon-receiving duct of the present invention.

FIG. 8 shows an alternative embodiment of the present invention used in association with a duct 80 which has an oval cross-section in a plane transverse to the longitudinal axis of the duct 80. The duct 80 also shows that the longitudinal channels 82, 84, 86 and 88 will open at the end 90 of the duct 80. The longitudinal channels 82, 84, 86 and 88 will communicate with each of the corrugations 92 extending outwardly of the wall 94 of the duct 80. Each of the longitudinal channels 82, 84, 86 and 88 will extend along the length of the duct 80 so as to open at the opposite end 96 of the duct 80. The longitudinal channels 82, 84, 86 and 88 will add rigidity to the duct 80 along its longitudinal axis. The channels 82, 84, 86 and 88 will also facilitate the ability to cause grout to migrate properly through the interior passageway 98 of the duct 80.

Figure 9:
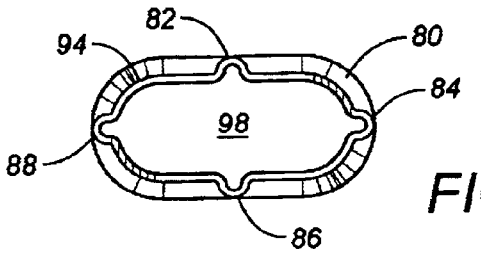
FIG. 9 is an end view showing the tendon-receiving duct of FIG. 8.

FIG. 9 shows a an end view of the duct 80. In particular, it can be seen the arrangement of the longitudinal channels

82, 84, 86 and 88 around the wall 94 of the duct 80. The longitudinal channels 82, 84, 86 and 88 open so as to communicate with the interior passageway 98 of the duct 80.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A tendon-receiving duct comprising:

a tubular body having a first end and a second end, said tubular body having a plurality of corrugations extending radially outwardly therefrom, each of said plurality of corrugations being in spaced relationship to an adjacent corrugation, said tubular body having an interior passageway suitable for receiving a tendon therein, each of said plurality of corrugations opening to said interior passageway, said tubular body having a longitudinal channel extending linearly across all of said plurality of corrugations between said first end and said second end of said tubular body, said plurality of corrugations being connected in fluid communcation with said longitudinal channel, said tubular body having a wall formed between the adjacent pairs of corrugations, said longitudinal channel opening through said wall and to said interior passageway, said longitudinal channel extending outwardly of said wall by a distance equal to a distance that said plurality of corrugations extend outwardly of said wall.

2. The duct of claim 1, said tubular body having a plurality of longitudinal channels extending across said plurality of corrugations.

3. The duct of claim 2, each of said plurality of longitudinal channels being spaced by an equal radial distance from an adjacent longitudinal channel of said plurality of longitudinal channels.

4. The duct of claim 1, said tubular body having a circular cross-section in a plane transverse to a longitudinal axis of said tubular body.

5. The duct of claim 1, said tubular body having an oval cross-section in a plane transverse to a longitudinal axis of said tubular body.

6. The duct of claim 1, further comprising:

a plurality of tendons extending through said interior passageway of said tubular body.

7. The duct of claim 1, said tubular body having a first end and a second end, said longitudinal channel having a one end opening at said first end and an opposite end opening at said second end, said longitudinal channel communicating with all of said plurality of corrugations between said first and second ends.

8. A tendon-receiving duct assembly comprising:

a tubular body having an interior passageway, said tubular body having a plurality of corrugations extending radially outwardly of said tubular body, each of said plurality of corrugations having an interior opening to said interior passageway, said tubular body having a channel formed on said tubular body so as to establish fluid communication between an adjacent pair of said plurality of corrugations, said tubular body being formed of a polymeric material; and a plurality of tendons extending through said interior passageway.

9. The assembly of claim 8, said tubular body having a wall extending between adjacent pair of said plurality of corrugations, said channel formed so as to extend outwardly of said wall, said channel communicating with said interior passageway.

10. The assembly of claim 9, said tubular body having a plurality of channels extending between the adjacent pairs of said plurality of corrugations, each of said plurality of channels being equally radially spaced from an adjacent channel on said wall.

11. The duct of claim 8, said channel extending outwardly from said tubular body by a distance equal to a distance that said plurality of corrugations extend outwardly of said tubular body.

12. The duct of claim 8, said tubular body having a circular cross-section in a plane transverse to a longitudinal axis of said tubular body.

13. A tendon-receiving duct comprising:

a tubular body having a first end and a second end, said tubular body having a plurality of corrugations extending radially outwardly therefrom, each of said plurality of corrugations being in spaced relation to an adjacent corrugation, said tubular body having an interior passageway, each of said plurality of corrugations opening to said interior passageway, said tubular body having a longitudinal channel having one end opening at said first end of said tubular body and an opposite end opening at said second end of said tubular body, said longitudinal channel being in fluid communication with said plurality of corrugations.

* * * * *